US008672239B2

(12) United States Patent
Ogura et al.

(10) Patent No.: US 8,672,239 B2
(45) Date of Patent: Mar. 18, 2014

(54) FUEL INJECTOR

(75) Inventors: Kiyotaka Ogura, Hitachinaka (JP); Yasuo Namaizawa, Naka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 933 days.

(21) Appl. No.: 12/817,813

(22) Filed: Jun. 17, 2010

(65) Prior Publication Data

US 2010/0320293 A1 Dec. 23, 2010

(30) Foreign Application Priority Data

Jun. 18, 2009 (JP) ..... 2009-144871

(51) Int. Cl.
*F02M 61/00* (2006.01)

(52) U.S. Cl.
USPC ..... 239/533.12; 239/552; 239/585.1; 239/585.5; 239/596; 239/601

(58) Field of Classification Search
USPC ..... 239/552, 556–561, 533.11, 533.12, 239/596, 585.1, 585.4, 585.5, 601
See application file for complete search history.

(56) References Cited

U.S. PATENT DOCUMENTS

| | | | | |
|---|---|---|---|---|
| 7,306,173 | B2 * | 12/2007 | Pilgram et al. | 239/585.5 |
| 7,669,789 | B2 * | 3/2010 | Hung et al. | 239/533.12 |
| 7,677,478 | B2 * | 3/2010 | Maier et al. | 239/585.4 |
| 8,083,160 | B2 * | 12/2011 | Kato et al. | 239/533.12 |
| 2002/0179039 | A1 | 12/2002 | Wuerfel | |
| 2007/0012805 | A1 | 1/2007 | Maier et al. | |
| 2009/0025680 | A1 | 1/2009 | Kihara et al. | |

FOREIGN PATENT DOCUMENTS

| | | | |
|---|---|---|---|
| CN | 1157881 | A | 8/1997 |
| FR | 2 862 719 | A1 | 5/2005 |
| JP | 2003-534495 | A | 11/2003 |
| JP | 2008-101499 | A | 5/2008 |
| WO | WO 2004/076851 | A1 | 9/2004 |

OTHER PUBLICATIONS

Chinese Office Action including partial translation dated Oct. 19, 2011 (Sixteen (16) pages).
Japanese Office Action with English translation dated Nov. 1, 2011 (eight (8) pages).
European Search Report dated Oct. 27, 2010 (six (6) pages).

* cited by examiner

*Primary Examiner* — Steven J Ganey
(74) *Attorney, Agent, or Firm* — Crowell & Moring LLP

(57) ABSTRACT

A fuel injector is disclosed that has plural nozzle holes with the same cross-sectional shape and can individually set the flow rate of each nozzle hole. The fuel injector includes the plural nozzle holes, a seat section positioned upstream of the nozzle holes, a valve element that closes a valve when brought into contact with the seat section and opens the valve when separated from the seat section, and a circular cone tapered from an upstream end to a downstream end and provided with the seat section and an inlet opening of the nozzle holes. The plural nozzle holes have an identical shape and a shape of a cross-section of each of the nozzle holes is substantially out-of-round, the cross-section being perpendicular to a central axis of each of the nozzle holes. The cross-section of each of the nozzle holes is rotated around the central axis of each of the nozzle holes. A rotation angle of the cross-section is set in such a manner that a relationship between a conical surface of the circular cone and the rotation angle is different among at least two of the nozzle holes.

4 Claims, 9 Drawing Sheets

FUEL INJECTOR

CLAIM OF PRIORITY

The present application claims priority from Japanese Patent Application JP 2009-144871 filed on Jun. 18, 2009, the content of which is hereby incorporated by reference into this application.

FIELD OF THE INVENTION

The present invention relates to a fuel injector for an automotive internal combustion engine.

BACKGROUND OF THE INVENTION

An electromagnetic fuel injector driven by an electrical signal from an engine control unit is widely used in automotive internal combustion engines.

This type of fuel injector is classified as either a port-injection type or a direct-injection type. A fuel injector of the port-injection type is mounted on an intake piping and injects fuel indirectly into a combustion chamber, whereas that of the direct-injection type injects fuel directly into the combustion chamber.

In the fuel injector of the direct-injection type, the spray shape formed by the injected fuel determines the combustion performance. To obtain desired combustion performance, therefore, it is necessary to optimize the spray shape. The spray shape optimization is achieved by optimizing the spray direction and the spray penetration when the fuel is injected at a specified flow rate.

Japanese Unexamined Patent Application Publication No. 2008-101499 discloses a fuel injector that includes a valve element which is movable; a driver which drives the valve element; a valve seat which is adjacent to the valve element; and plural orifices which are positioned downstream of the valve seat. The plural orifices are formed in different angular directions with respect to the central axis line of a nozzle of the fuel injector.

It is known that the spray from a fuel injector is emitted substantially in axial direction in which a nozzle hole is machined. When the fuel injector has plural nozzle holes (orifices), as is the case with the fuel injector described in Japanese Unexamined Patent Application Publication No. 2008-101499, it is demanded that the accuracy of machining in the direction of a nozzle hole be enhanced. Further, the spray penetration correlates with the flow rate of the fuel injected from each nozzle hole. It is therefore demanded that flow rate be controlled for each nozzle hole. In addition, it is demanded that the direction and flow rate of each spray be individually controlled in order to optimize the state of an air-fuel mixture.

The fuel injector described in Japanese Unexamined Patent Application Publication No. 2008-101499 does not set the flow rates of plural nozzle holes individually. One of the methods to individually set the flow rates of plural nozzle holes is, for instance, to vary the diameter of the plural nozzle holes, respectively. More specifically, the flow rate of each nozzle hole can be individually set by increasing the diameter of a nozzle hole for higher flow rate and by decreasing the diameter of a nozzle hole for lower flow rate.

However, in order to vary the diameter of the plural nozzle holes, it is necessary to prepare tools that match the diameters of the individual nozzle holes. In other words, it is necessary to prepare plural machining tools that provide holes with a varied diameter appropriate for desired flow rates and use the different machining tool to machine each of the nozzle holes. The number of process to prepare the tools increases with an increase in the number of nozzle hole sizes. Consequently, the time required for machining setup and post-machining inspection gets longer than when the diameters of all the nozzle holes are same, causing an increase in manufacturing cost of the fuel injector.

Further, when using different tools for machining plural nozzle holes, it is necessary to change the employed tool or transfer a nozzle hole formation material to a different machining device. Therefore, the tool may be relatively displaced from the material, causing a decrease in accuracy of nozzle hole machining.

The present invention provides a fuel injector that has plural nozzle holes with the same cross-sectional shape and can individually set the flow rate of each nozzle hole.

SUMMARY OF THE INVENTION

In the present invention, the cross-sectional shape of a nozzle hole, that is, the shape of a nozzle hole in the cross-section perpendicular to the central axis of the nozzle hole, is substantially out-of-round. The plural nozzle holes have the same cross-sectional shape. "The same cross-sectional shape" means that the cross-section is equal not only in shape but also in size. Each nozzle hole is formed so that its inlet is open to a substantially conical surface whose upstream diameter is larger than the downstream diameter. A seat section with which a valve element comes into contact is configured on the substantially conical surface, while the inlet of the nozzle hole is formed downstream of the seat section.

As the cross-sectional shapes of the plural nozzle holes are substantially out-of-round, an axis line (direction) O4 can be defined for the cross-sectional shapes of the plural nozzle holes. The flow rate of fuel injected from the nozzle hole can be changed by changing an angle (rotation angle) β that is formed on a plane S by an axis line O5 and the axis line O4, which is defined for the cross-sectional shape of the nozzle hole. The plane S is a plane that is perpendicular to the central axis of the nozzle hole and contains the cross-section for which the axis line (direction) O4 is defined. The axis line O5 is a line that is obtained when the center line O1 of the fuel injector main body is projected onto the plane S. The flow rates of fuel injected from the plural nozzle holes can be individually set by individually setting the rotation angle β for each of the plural nozzle holes.

The individual setting of the rotation angle β for each of the plural nozzle holes can be achieved by rotating the axis line O4 around the central axis of each nozzle hole and individually setting the rotation angle β for each nozzle hole. In this instance, the rotation angle β is set in such a manner that the relationship between the conical surface of a conical portion and the rotation angle varies from each nozzle.

"Substantially out-of-round" means substantially out-of-round to the extent that the flow rates of fuel injected from the nozzle holes can be individually set by changing the rotation angle β in a situation where the axis line (direction) is defined for the cross-sectional shapes of the nozzle holes.

When the central direction distance (radial direction distance) from the seat section is defined in the direction of a perpendicular line that is drawn from the seat section to the central axis of the fuel injector in a situation where the plural nozzle holes are set up as described above, changes in the opening width of the nozzle holes with respect to the central direction distance indicate that the volume of inflow varies with the opening width as the nozzle holes are positioned so as to provide different opening start points, different opening amplitudes, and different opening change rates.

In general, flow rate is calculated by the following equation:

$$\text{Flow rate } Q=cAv=cA((2/\rho)\Delta p)^{1/2} \quad \text{Equation 1}$$

where c is a flow rate coefficient, A is a cross-sectional area, v is flow velocity, and p is pressure.

Firstly, when the distance between the seat section and the opening start point decreases, the length of a gap flow formed by the valve element and the seat section decreases; flow path resistance decreases; pressure loss is reduced. As a result, the flow velocity increases. Therefore, when the distance between the seat section and the opening start point decreases, the flow rate into the nozzle hole opening increases.

Secondly, when the opening amplitude is great (that is, the opening change rate is high) while the distance between the seat section and the opening start point remains unchanged, the area of a flow path to the opening enlarges to increase the flow rate into the opening.

As described above, it is possible to individually design the flow rate of each nozzle hole by designing the opening start point, opening amplitude, and opening change rate with respect to the central direction distance from the seat section. In this case, the plural nozzle holes can be machined with the same tool, making it possible to reduce the manufacturing cost and provide an inexpensive fuel injector.

The present invention can provide a fuel injector that uses plural nozzle holes having the same cross-sectional shape and individually sets the flow rate of each nozzle hole. As a result, the fuel consumption and emission performance of an automotive internal combustion engine can be improved, for example. Further, a fuel injector can be provided at a significantly reduced manufacturing cost.

DETAILED DESCRIPTION OF THE INVENTION

Embodiments of the present invention will now be described with reference to the drawings.

Figure 1:
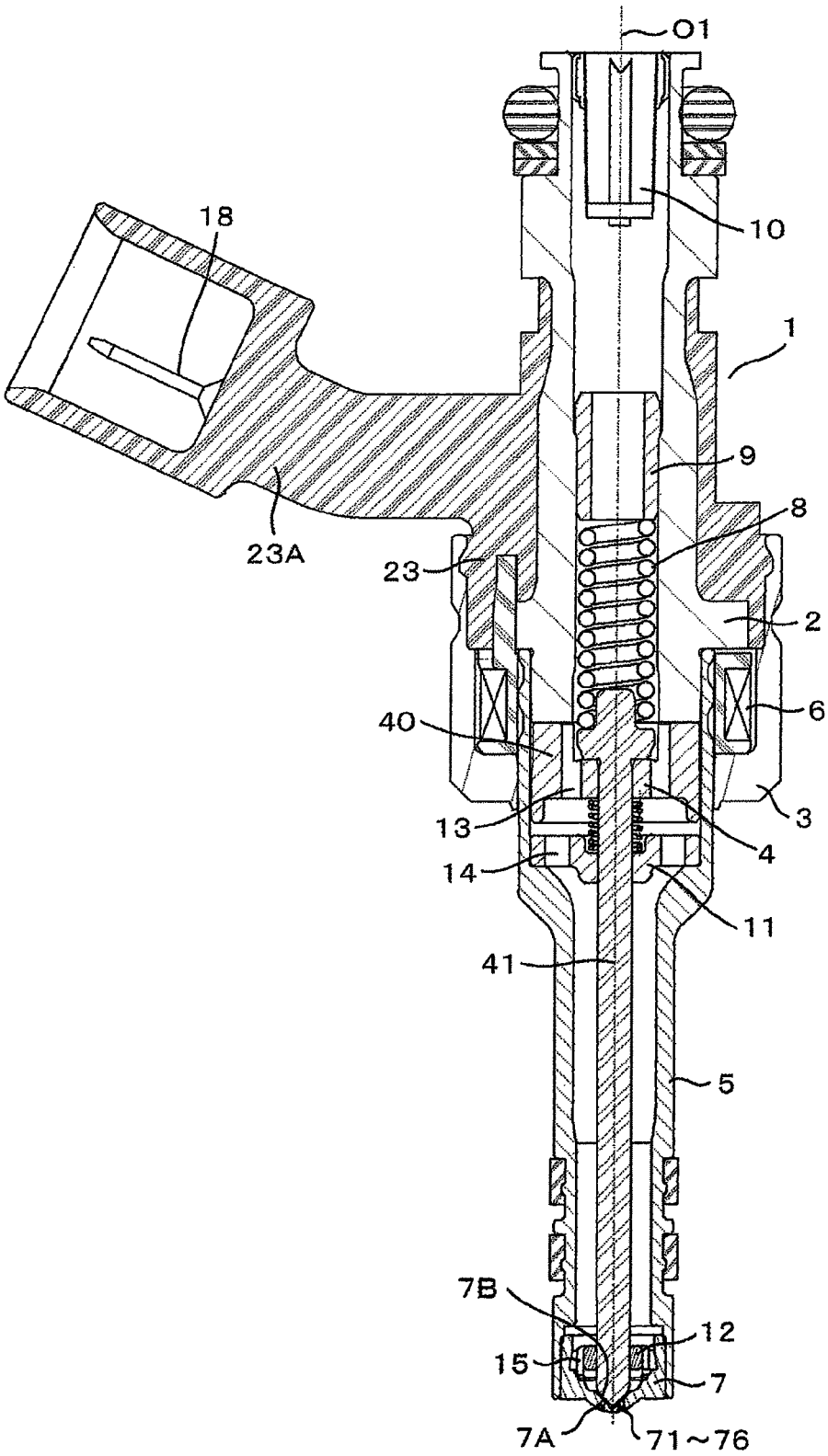
FIG. 1 is a longitudinal cross-sectional view illustrating the overall configuration of a fuel injector according to an embodiment of the present invention.

FIG. 1 is a longitudinal cross-sectional view illustrating the overall configuration of a fuel injector according to an embodiment of the present invention. The fuel injector according to the present embodiment directly injects gasoline or other fuel into an engine cylinder (combustion chamber).

A fuel injector main body 1 includes a hollow stationary core 2, a yoke 3, a movable element 4, and a nozzle body 5. The yoke 3 doubles as a housing. The movable element 4 includes a movable core 40 and a movable valve element 41. The stationary core 2, the yoke 3, and the movable core 40 constitute a magnetic circuit.

The yoke 3, the nozzle body 5, and the stationary core 2 are welded together. The welding operation may be performed in various manners. In the present embodiment, the nozzle body 5 and the stationary core 2 are welded together with a part of the outer circumference of the stationary core 2 fitted in a part of the inner circumference of the nozzle body 5. Further, the nozzle body 5 and the yoke 3 are welded together so that the yoke 3 surrounds a part of the outer circumference of the nozzle body 5. An electromagnetic coil 6 is embedded in the yoke 3. The electromagnetic coil 6 is covered and sealed with parts of the yoke 3, a plastic cover 23, and the nozzle body 5.

The movable element 4 is embedded in the nozzle body 5 and movable in the axial direction. An orifice cup 7, which is a part of the nozzle body, is welded to the leading end of the nozzle body 5. The orifice cup 7 includes nozzle holes (orifices) 71-76 to be described later and a conical surface 7A, which has a seat section 7B.

A spring 8, an adjuster 9, and a filter 10 are embedded in the stationary core 2. The spring 8 presses the movable element 4 against the seat section 7B. The adjuster 9 adjusts the spring force of the spring 8.

A guide member 12 is embedded in the nozzle body 5 and in the orifice cup 7 to guide the axial movement of the movable element 4. The guide member 12 is fixed to the orifice cup 7. Another guide member 11 is employed to guide the axial movement of the movable element 4 near the movable core 40. The movable element 4 is guided along the axial direction by the guide member 11 and the guide member 12 which are arranged one above the other.

The valve element (valve rod) 41 according to the present embodiment is of a needle type with a tapered end. Alternatively, the valve element 41 may have a sphere at its leading end.

A fuel passage in the fuel injector is composed of the inside of the stationary core 2, plural holes 13 provided for the movable core 40, plural holes 14 provided for the guide member 11, plural lateral grooves 15 provided for the guide member 12, and the conical surface 7A including the seat section 7B.

The plastic cover 23 is provided with a connector 23A for supplying an excitation current (pulse current) to the electromagnetic coil 6. A part of a lead terminal 18 insulated by the plastic cover 23 is located in the connector 23A.

When an external drive circuit (not shown) excites the electromagnetic coil 6 in the yoke 3 via the lead terminal 18, the stationary core 2, yoke 3, and movable core 40 form a magnetic circuit so that the movable element 4 is magnetically attracted toward the stationary core 2 against the force of the spring 8. In this instance, the valve element 41 leaves the seat section 7B to open the valve. As a result, the fuel in the fuel injector main body 1, which is already pressurized (to 1 MPa or higher) by an external high-pressure pump (not shown), is injected from the nozzle holes 71-76.

When the electromagnetic coil 6 is de-energized, the spring 8 presses the valve element 41 against the seat section 7B to close the valve.

Figure 2:
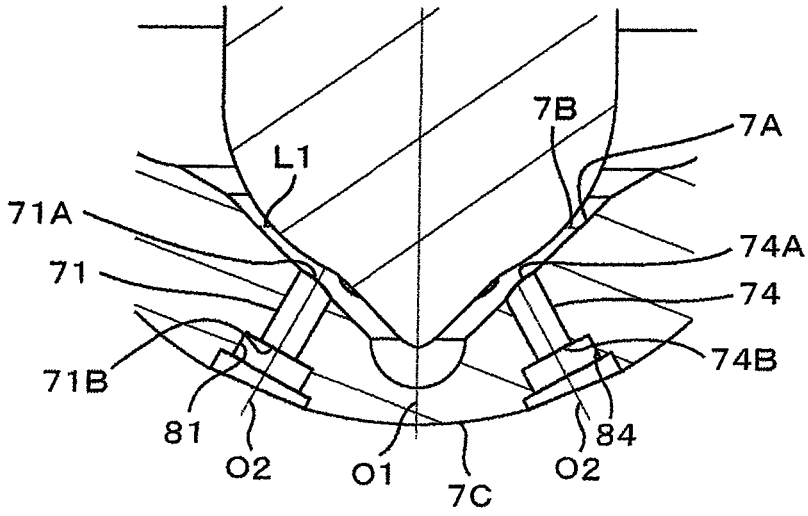
FIG. 2 is a longitudinal cross-sectional view illustrating the vicinity of an area where nozzle holes of an orifice cup are formed.

The structures of the orifice cup 7 and the nozzle holes 71-76, which are parts of the nozzle body, will now be described with reference to FIG. 2. FIG. 2 is a longitudinal cross-sectional view illustrating the vicinity of an area where the nozzle holes 71-76 of the orifice cup 7 are formed in the fuel injector main body 1. It should be noted that the nozzle hole 71 and the nozzle hole 74 are shown in FIG. 2.

A convexly curved section 7C is formed on the outer surface of the leading end of the orifice cup 7. The conical surface 7A containing the seat section 7B is formed on the opposite inner surface of the convexly curved section 7C. In the present embodiment, the convexly curved section 7C is spherically formed. The orifice cup 7 is provided with the plural nozzle holes 71-76. The number of nozzle holes can be determined as desired. In the present embodiment, the orifice cup 7 is provided with six nozzle holes 71, 72, 73, 74, 75, and 76. Inlets 71A-76A of the nozzle holes 71-76 are open in the conical surface 7A and arbitrarily positioned downstream of a seat line L1 of the seat section 7B.

The convexly curved section 7C is provided with concave sections (countersinks) 81, 82, 83, 84, 85, and 86. The concave sections have a circular opening whose center line coincides or substantially coincides with the center line O2 of the nozzle holes 71-76.

The diameters of the concave sections 81-86 are larger than the maximum diameters of the nozzle holes 71-76. The bottom surfaces of the concave sections 81-86 are respectively perpendicular or substantially perpendicular to the center lines O2 of the nozzle holes and the center lines of the concave sections 81-86. Outlets 71B-76B of the nozzle holes 71-76 are open in the bottom surfaces of the concave sections 81-86. In other words, the outlets 71B-76B are positioned toward the convexly curved section 7C.

The nozzle hole length, which is expressed by the distance between the inlets 71A-76A and outlets 71B-76B of the nozzle holes 71-76, is a factor that determines the length of penetration of the injected fuel spray (the spray penetration). The lengths of the nozzle holes 71-76 can be optimally set by appropriately changing the depths of the concave sections 81-86 without changing the thickness of the orifice cup 7. This makes it possible to optimize the spray shape of the injected fuel and facilitate the machining of the nozzle holes 71-76. Further, as the thickness of the orifice cup 7 is not needed to be changed in accordance with the nozzle hole length, the rigidity of the orifice cup 7 can be maintained. The orifice cup 7, structured as described above, is suitable for a fuel injector of a high fuel pressure type that achieves a fuel injection pressure of 10 MPa or higher.

Each of the nozzle holes 71-76 has a different depth of the concave section from others. Thus, the nozzle hole length also varies from one nozzle hole to another. Further, the inclination angle between neighboring nozzle holes of the nozzle holes 71-76 also varies from one nozzle hole to another. That is, the nozzle hole inclination angle θ relative to the center line O1 of the fuel injector main body 1 (the angle between the center line O1 of the fuel injector main body 1 and the center line O2 of each nozzle hole) varies from one nozzle hole to another. The nozzle holes can be oriented in various directions depending on engine specifications. For instance, in the mounting of the fuel injector in an engine, one nozzle hole is set to point toward an ignition plug (not shown); some other nozzle holes are set to point toward the top of the piston (not shown); and the remaining nozzle holes are set to point toward the middle between the ignition plug and the piston.

Formation of the nozzle holes is performed according to the following process. First of all, a blank to become the orifice cup 7 is fixed. The convexly curved section 7C is beforehand formed in the blank by cutting, press punching, or other ways. The blank is press punched using a punch so that the concave section 81 is formed in a blind hole shape by extrusion from the convexly curved section 7C. Then a blind hole to be the nozzle hole 71 is formed, using a punch for forming the nozzle hole 71, by extrusion from the bottom surface of the concave section 81 in the direction perpendicular to the bottom surface. The press punching during the formation of the concave section 81 and nozzle hole 71 is performed to provide the inclination angle with a correction amount. The nozzle hole 71 is completed subsequently by cutting process to form the conical surface 7A, which contains the seat section (valve seat) 7B, on a surface opposite to the surface on which the aforementioned extrusion of the blank was performed. The remaining concave sections 82-86 and nozzle holes 72-76 are formed in the same manner.

Parameters for setting the nozzle hole will now be described with reference to FIGS. 3 to 7.

Figure 3:
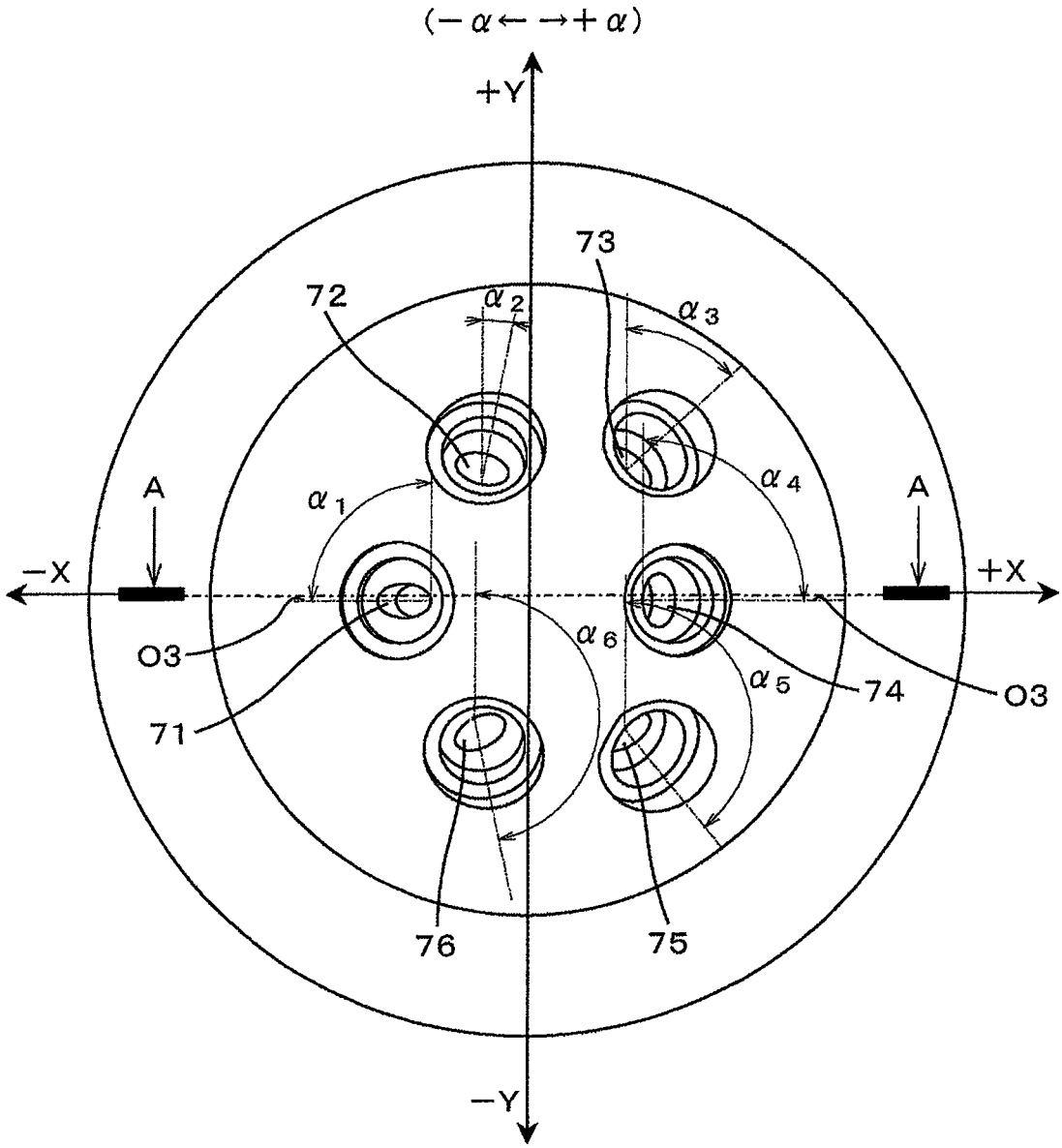
FIG. 3 shows nozzle hole outlets of an orifice cup viewed in the direction of the center line of a fuel injector main body.

FIG. 3 shows the outlets 713-763 of the nozzle holes 71-76 of the orifice cup 7 viewed in the direction of the center line O1 of the fuel injector main body 1. As shown in FIG. 3, the X-axis and Y-axis are defined. More specifically, the X-axis and Y-axis are on a plane perpendicular to the center line O1 of the fuel injector main body 1, passing through the center of the orifice cup 7, and being orthogonal to each other. In the present embodiment, an axis line O3, which is obtained when the center line O2 of the nozzle holes 71, 74 is projected onto the X-Y plane, is superposed over the X-axis. To facilitate understanding, however, the axis line O3 is slightly displaced from the X-axis in FIG. 3. In FIG. 3, the angles formed between the Y-axis and the central axes O3 of each nozzle hole are variously designated. More specifically, the angle between the Y-axis and the central axis O3 of the nozzle hole 71 is designated as α1; the angle between the Y-axis and the central axis O3 of the nozzle hole 72 is designated as α2; the angle between the Y-axis and the central axis O3 of the nozzle hole 73 is designated as α3; the angle between the Y-axis and the central axis O3 of the nozzle hole 74 is designated as α4; the angle between the Y-axis and the central axis O3 of the nozzle hole 75 is designated as α5; and the angle between the Y-axis and the central axis O3 of the nozzle hole 76 is designated as α6.

Figure 4:
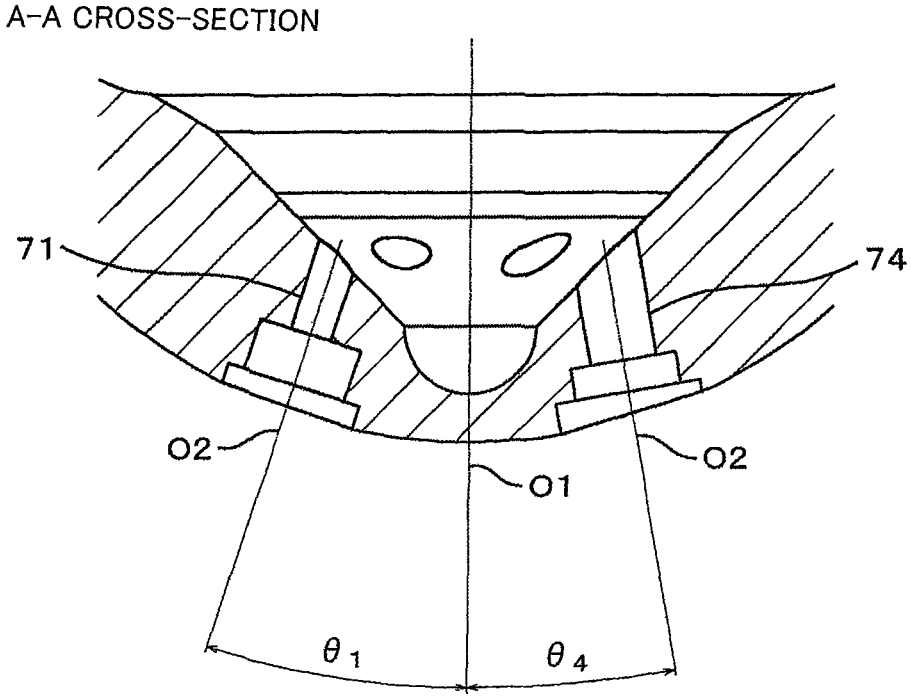
FIG. 4 is a longitudinal cross-sectional view illustrating only the vicinity of nozzle holes taken along the line A-A of FIG. 3.

FIG. 4 is a longitudinal cross-sectional view illustrating only the vicinity of the nozzle holes 71, 74 taken along the line A-A of FIG. 3. That is, FIG. 4 shows the nozzle holes 71, 74 on the cross-section taken along the line A-A (the A-A cross-section) in FIG. 3. The line A-A coincides with the X-axis of FIG. 3. The central axes O2 of the nozzle holes 71, 74 exist on the A-A cross-section. The angle formed between the center line O1 of the fuel injector main body 1 and the central axis O2 of the nozzle hole 71 is designated as θ1, whereas the angle between the center line O1 and the central axis O2 of the nozzle hole 74 is designated as θ4. Similarly, the angles between the center line O1 and the central axes of the nozzle holes 72, 73, 75, and 76 are designated as θ2, θ3, θ5, and θ6, respectively.

Figure 5:
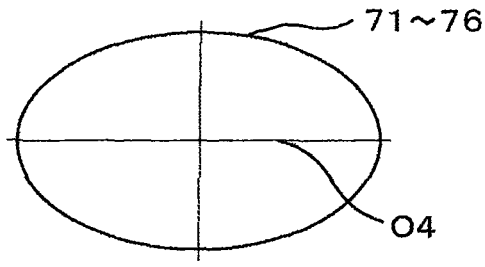
FIG. 5 shows the cross-sectional shape of a nozzle hole according to an embodiment of the present invention.

In the present embodiment, the cross-section (transverse cross-section) perpendicular to the central axes O2 of the nozzle holes 71-76 has an elliptical shape as shown in FIG. 5. The long axis of the nozzle hole is defined as an axis line O4. As far as the transverse cross-sectional shape of a nozzle hole is substantially out-of-round, as is the case with the aforementioned elliptical cross-section, the orientation of the transverse cross-sectional shape can be defined on a plane perpendicular to the central axis O2 of the nozzle hole. In the case of the aforementioned elliptical cross-section, for example, the transverse cross-sectional shape has a long axis direction and a short axis direction. Therefore, the long axis direction (the direction of the axis line O4) can define the orientation of the transverse cross-sectional shape on the plane perpendicular to the central axis O2 (see a plane S71 in FIG. 6 and a plane S74 in FIG. 7), for instance.

Figure 6:
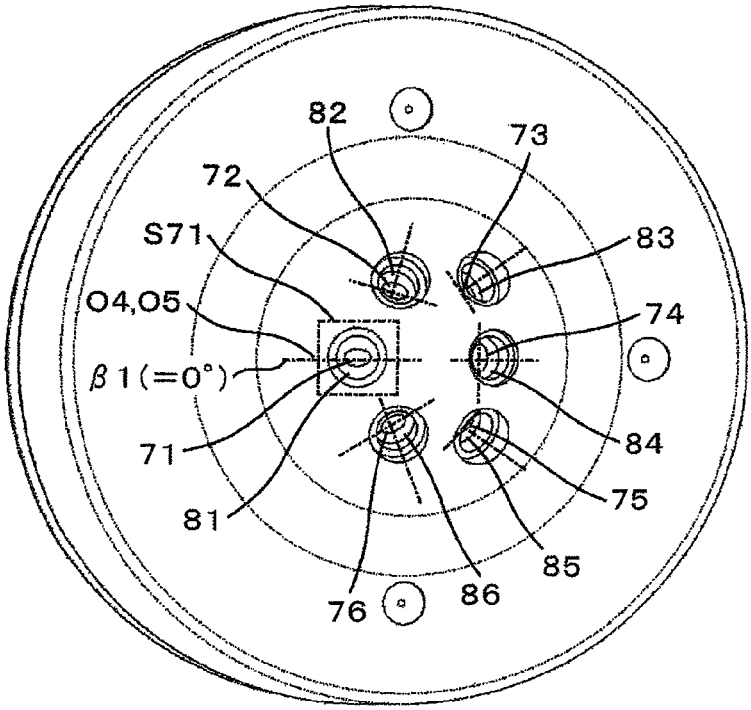
FIG. 6 shows the nozzle hole outlets of an orifice cup viewed in the direction of the central axis of a nozzle hole 71.
Figure 7:
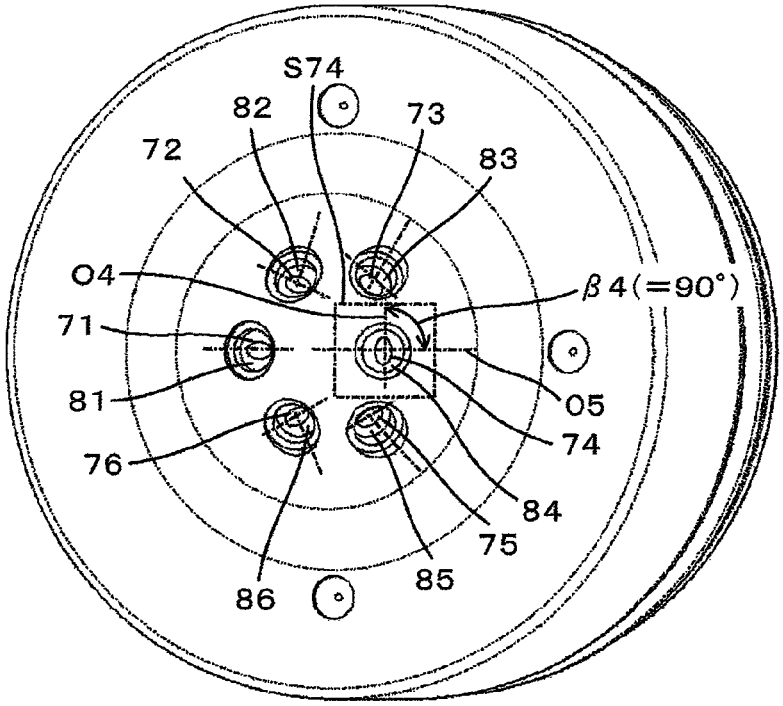
FIG. 7 shows the nozzle hole outlets of an orifice cup viewed in the direction of the central axis of a nozzle hole 74.

FIG. 6 shows the outlets 71B-76B of the nozzle holes 71-76 of the orifice cup 7 viewed in the direction of the central axis O2 of the nozzle hole 71. FIG. 7 shows the outlets 71B-76B of the nozzle holes 71-76 of the orifice cup 7 viewed in the direction of the central axis O2 of the nozzle hole 74. In FIG. 6, the plane S71 is defined as a plane perpendicular to the central axis O2 of the nozzle hole 71 and containing the cross-section of the nozzle hole 71. Further, the axis line O5 is defined as an axis line that is obtained by projecting the center line O1 of the fuel injector main body 1 onto the plane S71. An angle (rotation angle) formed on the plane S71 between the axis line O4, which indicates the direction of the cross-sectional shape of the nozzle hole 71, and the axis line O5 is designated as the angle β1. In the present embodiment, β1=0°. In FIG. 7, the plane S74 is defined as a plane perpendicular to the central axis O2 of the nozzle hole 74 and contains the cross-section of the nozzle hole 74. An angle (rotation angle) formed between the axis line O5, which is obtained by projecting the center line O1 of the fuel injector main body 1 onto the plane S74, and the axis line O4, which indicates the direction of the cross-sectional shape of the nozzle hole 74, is designated as the angle β4. In the present embodiment, β4=90°. As the angle β1 and the angle β4 are different from each other, the flow rates of the injected fuel are set to differ between the nozzle hole 71 and the nozzle hole 74.

The angle β1 for the nozzle hole 71 is set to 0°. Therefore, when the axis line O4 of the nozzle hole 71 is projected onto the conical surface 7A, the axis line O4 coincides with the generatrix of the conical surface 7A. The angle β4 for the nozzle hole 74 is set to 90°. Therefore, when the axis line O4 of the nozzle hole 74 is projected onto the conical surface 7A, the axis line O4 extends along the circumferential direction of the conical surface 7A.

As for the nozzle holes 72, 73, 75, and 76, planes S72, S73, S75, and S76 (not shown), can be defined, as is the case with the planes S71 and S74. The planes S72, S73, S75, and S76 are perpendicular to the central axes O2 of the nozzle holes 72, 73, 75, and 76, respectively, and contain the cross-section of the nozzle holes 72, 73, 75, and 76, respectively. In addition, the axis line O5 can be defined as a line obtained by projecting the center line O1 of the fuel injector main body 1 onto these planes. Further, angles (rotation angles) formed on these planes S72, S73, S75, and S76 between the axis line O5 and the axis lines O4, which indicate the directions of the cross-sectional shape of the nozzle holes 72, 73, 75, and 76, respectively, can be defined as angles β2, β3, β5, and (β6, respectively.

When the cross-sectional shape of the nozzle holes 71-76 is substantially out-of-round and the cross-section (or axis line O4) of the nozzle holes 71-76 is rotated around the central axis O2 of the nozzle holes 71-76, the relationship between the conical surface 7A and the opening surface of the nozzle holes 71-76 varies with the angle of such rotation as described above. Conversely, the relationship between the conical surface 7A and the opening surface of the nozzle holes 71-76 can be varied by setting the rotation angles β1-β6 of the nozzle holes in such a manner that the relationship between the conical surface 7A and axis line O4 varies among the nozzle holes 71-76.

When at least one of the rotation angles (β1, β2, β3, β4, β5, and β6 differs from the others, the nozzle hole with different rotation angle β has different flow rate from the other nozzle holes have. It goes without saying that all the nozzle holes 71-76 may have different rotation angles from each other. More specifically, each of the flow rates of the nozzle holes 71-76 can be individually set by setting each of the rotation angles β1-β6, respectively.

The present embodiment assumes $|\beta| \leq 90°$. Each of the flow rates of the nozzle holes can be set by setting the above-described parameters (θ, α, and β) and the nozzle hole length on an individual nozzle hole basis.

Figure 8:
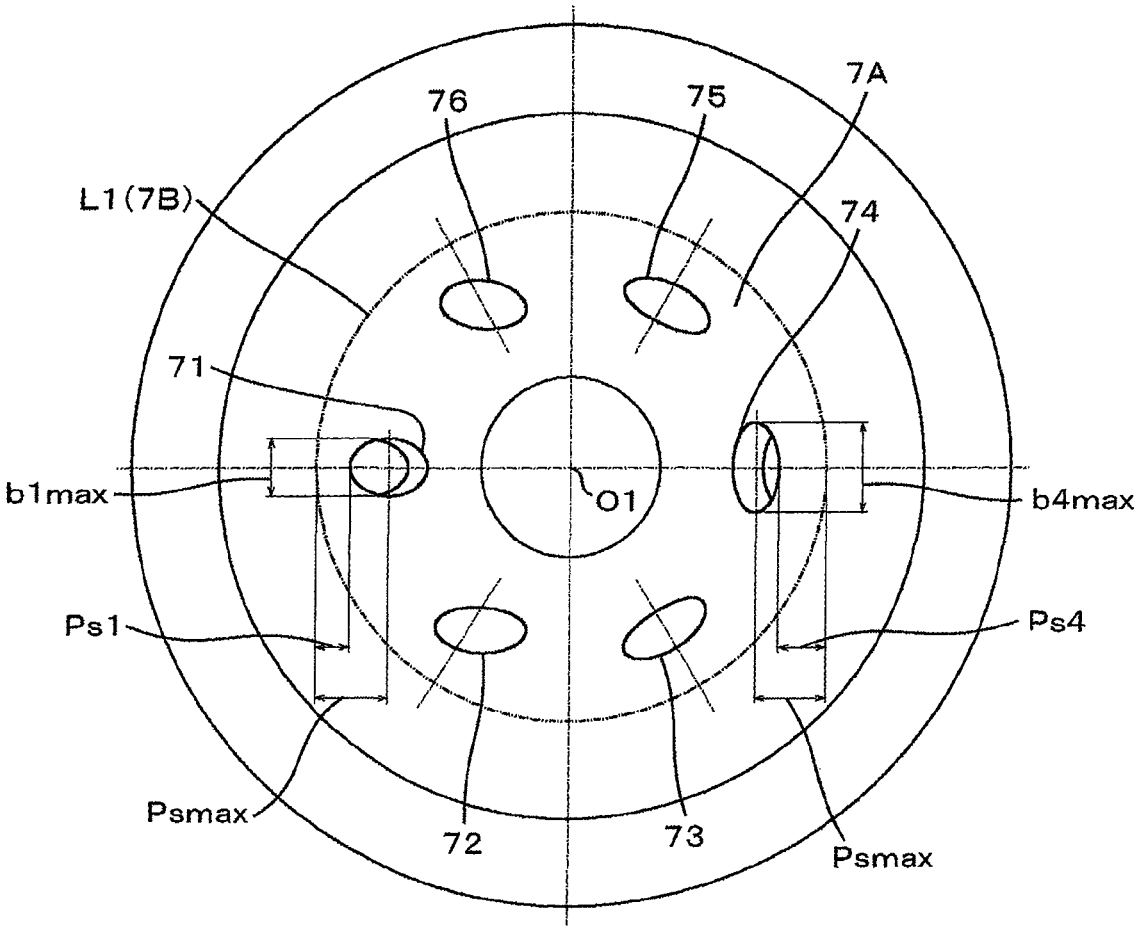
FIG. 8 shows an orifice cup 7 viewed from a seat section 7B.
Figure 9:
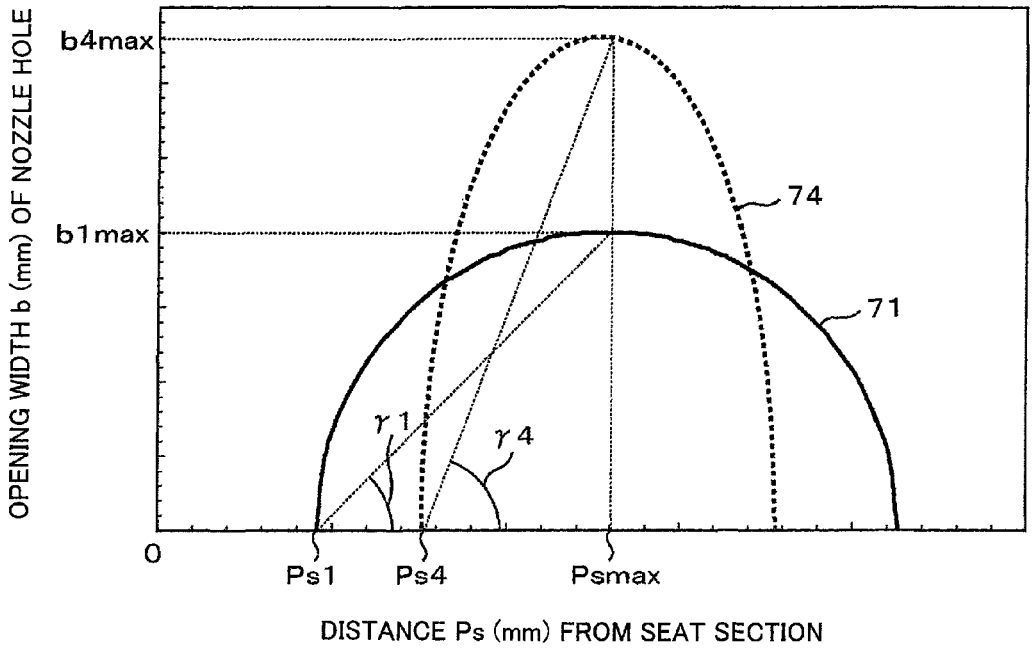
FIG. 9 is a diagram illustrating the relationship between the distance Ps from a seat line L1 and the opening width b of a nozzle hole.

FIG. 8 shows the orifice cup 7 viewed from the seat section 7B. The symbol Ps denotes the distance from the seat line L1 in the direction of a perpendicular line drawn from the seat line L1 formed by the seat section 7B to the center line O1 of the fuel injector main body 1. The symbol b denotes the nozzle hole opening width (the length in the direction perpendicular to the distance direction) that varies with the distance Ps from the seat line L1. FIG. 9 shows the relationship between the distance Ps and the nozzle hole opening width b.

In the case of the nozzle hole 71, for example, the opening start point is designated as Ps1; the distance to the maximum opening width part is designated as Psmax; and the maximum opening width is designated as b1max. In this instance, as shown in FIG. 9, the angle formed between the Ps axis (the horizontal axis) and a line segment from the start point (Ps1, 0) to the maximum point (Psmax, b1max) of the opening width b is designated as γ1. Similarly, in the case of the nozzle hole 74, the angle formed between the Ps axis and a line segment from the start point (Ps4, 0) to the maximum point (Psmax, b4max) of the opening width b is designated as γ4. It is obvious that the nozzle holes 71 and 74 differ in the opening start point (Ps1 and Ps4) and inclination angle γ (γ1 and γ4) when their rotation angles β are different (β1≠β4). If the inclination angle γ is large, the opening area for inflow into the nozzle hole drastically enlarges, thereby increasing the rate of inflow into the nozzle hole. In other words, the nozzle hole flow rate Q is proportional to the inclination angle γ.

Further, the nozzle hole flow rate Q varies with the position of the opening start point. If Ps is large, the flow path between the seat section and the nozzle hole opening is long. Therefore, as Ps increases, the fluid resistance increases and the flow rate Q decreases. In other words, the nozzle hole flow rate Q is inversely proportional to Ps.

Figure 10:
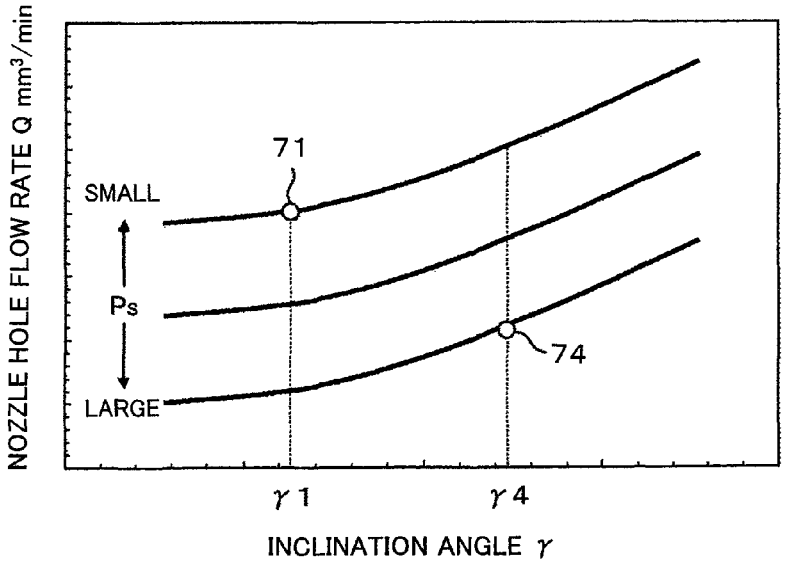
FIG. 10 is a graph representing the relationship among the nozzle hole flow rate Q, the inclination angle γ, and the distance Ps by the expression $Q \propto \gamma/Ps$.

Consequently, the relationship among the nozzle hole flow rate Q, the inclination angle γ, and the distance Ps can be expressed by the expression $Q \propto \gamma/Ps$. FIG. 10 is a graph representing this relation. In the present embodiment, the flow rate of the nozzle hole 71 is greater than that of the nozzle hole 74.

In the present embodiment, the cross-sectional shapes of the nozzle holes 71-76 are substantially out-of-round so that the angles (rotation angles or orientations) β1-β6 of the axis lines of the cross-sectional shapes of the nozzle holes 71-76 are individually set for the plural nozzle holes 71-76. In other words, the angles (rotation angles) β1-β6 are individually set. The angles β1-β6 are formed between the axis line O5 and the axis line O4. The axis line O5 is obtained by projecting the center line O1 of the fuel injector main body 1 onto the planes S71-S76 that are perpendicular to the central axis O2 of the nozzle holes 71-76 and contain the cross-section of the nozzle holes 71-76. The axis line O4 defines the directions of the cross-sectional shapes of the nozzle holes 71-76. Therefore, the flow rates of the fuel injected from the nozzle holes 71-76 can be individually set. "Substantially out-of-round" means substantially out-of-round to the extent that the flow rates of the fuel injected from the nozzle holes can be individually set by changing the rotation angle β in a situation where the direction of the cross-sectional shapes of the plural nozzle holes can be defined.

Figure 11:
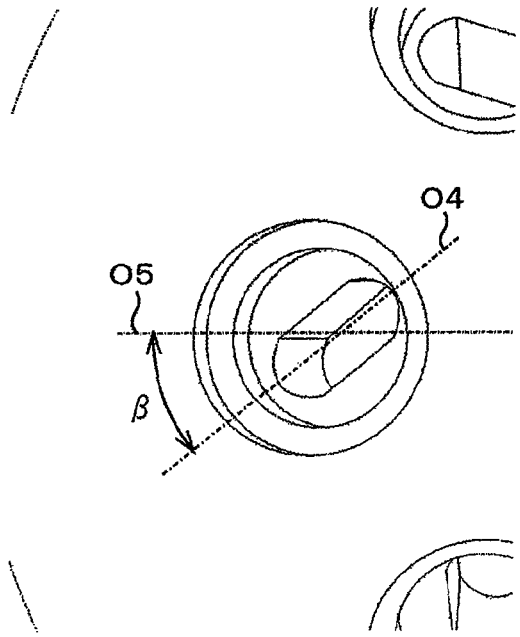
FIG. 11 shows an oval cross-sectional shape as an example of the cross-sectional shape of a nozzle hole.
Figure 12:
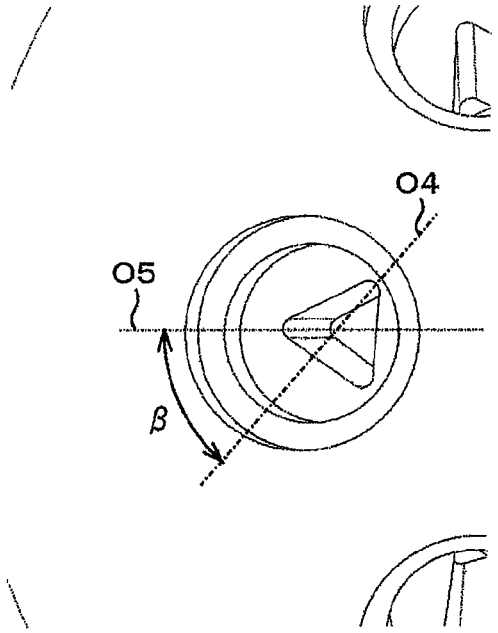
FIG. 12 shows a triangular cross-sectional shape as an example of the cross-sectional shape of a nozzle hole.
Figure 13:
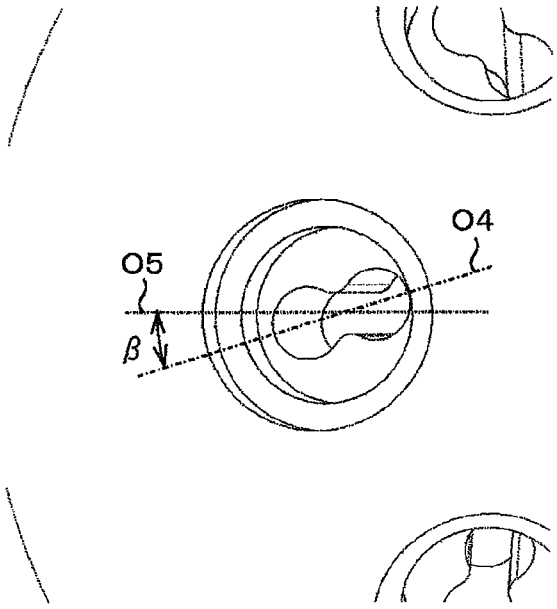
FIG. 13 shows a gourd-shaped cross-sectional shape as an example of the cross-sectional shape of a nozzle hole.
Figure 14:
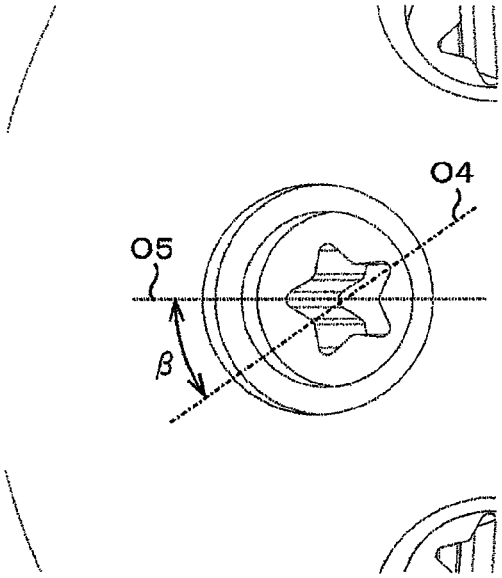
FIG. 14 shows a star-shaped cross-sectional shape as an example of the cross-sectional shape of a nozzle hole.

The aforementioned embodiment assumes that the cross-sectional shapes of the nozzle holes are elliptical. As described above, however, the present invention is applicable to a situation where the cross-sectional shapes are substantially out-of-round. Therefore, the present invention is also effective when, for instance, the cross-sectional shape is oval as shown in FIG. 11, triangular as shown in FIG. 12, gourd-shaped as shown in FIG. 13, star-shaped as shown in FIG. 14, or of a shape having an outline that has two or more identical radii or different radii.

The nozzle hole shapes according to the above-mentioned embodiments can be formed by press punching (press working). The manufacturing cost of the nozzle holes is substantially equal to a case where the nozzle holes have truly circular shapes. The flow rates can be easily optimized by controlling the rotation angles β of the nozzle holes. Therefore, the manufacturing cost can be significantly reduced compared to when nozzle holes are formed into plural shapes by machining.

The manufacturing method of the nozzle hole is not limited to press punching. For instance, an electro-discharge machining, edging, or laser machining may be employed, using the same tool, in the manufacturing. In such an alternative case, too, the manufacturing cost can be reduced because there is no need to prepare plural tools that are employed to machine the plural nozzle hole shapes.

What is claimed is:

1. A fuel injector for an automotive internal combustion engine, comprising:

a plurality of nozzle holes;

a seat section positioned upstream of the nozzle holes;

a valve element that closes a valve when brought into contact with the seat section and opens the valve when separated from the seat section; and a circular cone that is substantially conical in shape, tapered from an upstream end to a downstream end, and provided with the seat section and an inlet opening of the nozzle holes, wherein the plurality of nozzle holes have an identical shape and a shape of a cross-section of each of the nozzle holes is substantially out-of-round, the cross-section being perpendicular to a central axis of each of the nozzle holes, and wherein the cross-section of each of the nozzle holes is rotated around the central axis of each of the nozzle holes; a rotation angle of the cross-section is set in such a manner that a relationship between a conical surface of the circular cone and the rotation angle is different among at least two of the nozzle holes; and wherein a first axis line is formed by projecting a center line of a fuel injector main body onto a plane, the plane contains the cross-section and is perpendicular to the central axis of each of the nozzle holes; a second axis line is defined for the cross-section of each of the nozzle holes; angle β is formed by the first axis line and the second axis line on the plane; at least two of the nozzle holes differ in the angle β.

2. The fuel injector according to claim 1, wherein a direction of a perpendicular line is defined as a direction from the seat section to the center line of the fuel injector main body; distance from the seat section to an opening start point of each of the nozzle holes in the direction of the perpendicular line is different among at least two of the nozzle holes.

3. The fuel injector according to claim 2, wherein maximum width of an opening of each of the nozzle holes and distance from the opening start point to a point at which the width of the opening is maximum in the direction of the perpendicular line is different among at least two of the nozzle holes.

4. A fuel injector for an automotive internal combustion engine, comprising:

a plurality of nozzle holes;

a seat section positioned upstream of the nozzle holes;

a valve element that closes a valve when brought into contact with the seat section and opens the valve when separated from the seat section; and a circular cone that is substantially conical in shape, tapered from an upstream end to a downstream end, and provided with the seat section and an inlet opening of the nozzle holes, wherein the plurality of nozzle holes have an identical shape and a shape of a cross-section of each of the nozzle holes is substantially out-of-round, the cross-section being perpendicular to a central axis of each of the nozzle holes, and wherein the cross-section of each of the nozzle holes is rotated around the central axis of each of the nozzle holes; a rotation angle of the cross-section is set in such a manner that a relationship between a conical surface of the circular cone and the rotation angle is different among at least two of the nozzle holes, and wherein a direction of a perpendicular line is defined as a direction from the seat section to the center line of the fuel injector main body; distance from the seat section to an opening start point of each of the nozzle holes in the direction of the perpendicular line is different among at least two of the nozzle holes.

* * * * *